US007290345B2

(12) United States Patent
Ellig

(10) Patent No.: US 7,290,345 B2
(45) Date of Patent: Nov. 6, 2007

(54) BOW SIGHT WITH CONTROLLED LIGHT INTENSITY SIGHT PIN

(75) Inventor: Michael J. Ellig, Bozeman, MT (US)

(73) Assignee: Montana Black Gold, Bozeman, MT (US)

( * ) Notice: Subject to any disclaimer, the term of this patent is extended or adjusted under 35 U.S.C. 154(b) by 0 days.

(21) Appl. No.: 11/277,710

(22) Filed: Mar. 28, 2006

(65) Prior Publication Data

US 2007/0227018 A1 Oct. 4, 2007

(51) Int. Cl.
*F41G 1/467* (2006.01)
*F41G 1/00* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS

| | | | | |
|---|---|---|---|---|
| 4,166,324 | A | 9/1979 | Carrollo et al. | |
| 4,495,705 | A | 1/1985 | Kowalski et al. | |
| 4,620,372 | A | 11/1986 | Goodrich | |
| 4,813,150 | A | 3/1989 | Colvin | |
| 5,048,193 | A | 9/1991 | Hacquet | |
| 5,094,002 | A | 3/1992 | Saunders | |
| 5,649,526 | A | 7/1997 | Ellig | |
| 5,862,603 | A | 1/1999 | Ellig | |
| 6,247,237 | B1 | 6/2001 | Redburn et al. | |
| 6,418,633 | B1 | 7/2002 | Rager | |
| 6,446,347 | B1 | 9/2002 | Springer | |
| 6,581,317 | B1 | 6/2003 | Slates | |
| 6,725,854 | B1 * | 4/2004 | Afshari | 124/87 |
| 6,796,037 | B1 | 9/2004 | Geffers et al. | |
| 6,981,329 | B1 * | 1/2006 | Strathman | 33/265 |
| 7,089,698 | B2 * | 8/2006 | Afshari | 43/4.5 |
| 7,100,291 | B2 * | 9/2006 | Afshari | 33/265 |
| 2002/0083602 | A1 | 7/2002 | Slates | |
| 2004/0244211 | A1 * | 12/2004 | Afshari | 33/265 |
| 2005/0150119 | A1 | 7/2005 | Ellig et al. | |
| 2005/0235503 | A1 * | 10/2005 | Afshari | 33/265 |
| 2006/0156561 | A1 * | 7/2006 | Afshari | 33/265 |

* cited by examiner

*Primary Examiner*—Yaritza Guadalupe-McCall
(74) *Attorney, Agent, or Firm*—Blackwell Sanders LLP

(57) ABSTRACT

An improved sighting device is provided. The sight may be used on a bow or other device which is typically sighted on an object during use. The sight includes at least one light-gathering fiber-optic fiber having at least one end from which absorbed light may be transmitted for viewing by a user. The fiber-optic fiber includes an associated element that regulates the amount of light absorbed in inverse proportion to the impinging light intensity in an automatic manner providing a more constant light intensity output.

5 Claims, 3 Drawing Sheets

BOW SIGHT WITH CONTROLLED LIGHT INTENSITY SIGHT PIN

BACKGROUND OF THE INVENTION

Sights for bows have evolved dramatically in the last few decades. An early sight provided a track mounted to the bow and allowed for both windage and elevation adjustment of pins movably mounted to the track. Usually a plurality of pins were used and set for different predetermined ranges for the individual bow and archer. These sights provided an advance in the art for archers over earlier sighting methods. One earlier method of aiming included the use of a consistent nock end anchor point and then using the arrow tip as the front sight which was an effective method for skilled archers but not necessarily for occasional archers. Bows have likewise advanced dramatically in the last few decades from the traditional long bow or recurve bow to the so called compound bow. Crossbows have also made similar advances. Attachment of sight devices to a traditional bow such as a long bow or recurve bow posed problems with potential damage to the structural integrity of the bow sometimes causing the bow to fail particularly in laminated bows commonly referred to as fiberglass bows. Bows now have metallic risers that permit the attachment of numerous devices to the bow without risk of damage to the bow or its structural integrity. Such devices include sophisticated arrow rests, lights, sights with lenses, reels, stabilizers and pin sights. A second or rear sight can also be provided and may be mounted to the bow string to help improve accuracy. Modern bows with sights are extremely accurate and sophisticated. The modern bow is complex and can be considered a complex machine.

Bows that are used for hunting are used in highly variable conditions, particularly highly variable conditions of lighting both as to light intensity (e.g., lumens) and "color" (usually expressed in ° K). The original multi-pin sight, while effective, had its drawbacks. A major drawback of such sights was the visibility of the pins in low light and when viewed on certain backgrounds or targets. Much hunting is done in the morning and in evening when light is low in intensity and/or color. Also, on overcast days, light can be sufficiently low to make the pins difficult to see and to see against a dark background as is not uncommon during hunting and also target shooting.

An early attempt to solve the sight pin visibility problem was to paint the tip of the pin with a light colored or luminescent paint usually using a different color for each pin. The plurality of colors on the pins was used to help quickly identify which range the pin was meant for. The next advance in such sights was to provide a low light-output battery-powered light which would be turned on selectively to illuminate the pins. However, this required batteries which could "burn out" or the light bulb could "burn out". While effective, there were still disadvantages.

The next advance in sights was the use of fiber optics. Typically, such fiber optics were a single fiber polymeric fiber that absorbed light through the side which light would then project out of the ends of the fiber optic element or fiber. No batteries were required and such fiber optic sights have been commonly used for bow sights and other shooting device sights such as, pistol, rifle and shotgun sights. An easy to view dot of light was provided and no batteries were required. Additionally, such fiber optics could be made in a variety of colors which was beneficial for a multi-pin sight, such as that used on a bow, to help quickly provide differentiation as to which range pin was being viewed. However, even these sights had drawbacks. Sometimes, to gather enough light, the fiber optic was made longer than was convenient for use on a small sight. Additionally, the diameter (the fiber optic fiber was typically round in transverse cross-section) of the sighting end of the fiber optic tended to be large in order for the fiber optic to gather enough light to be readily viewable. The size of the sighting end sometimes interfered with viewing of the target.

One major drawback of fiber optic sights is that when the sight is tuned for low light, to provide enough light absorption and projection in a low light condition, the light projection was often too intense during high light conditions. To tune the sight for high light conditions would then mean not enough light was absorbed and projected for low light conditions. Thus, current sight technology presents mutually exclusive design and use criteria.

There is thus a need for an improved fiber optic sight.

SUMMARY OF THE INVENTION

The present invention involves the provision of a fiber optic sight that has a fiber with an outer surface extending between opposite end portions of the fiber. The fiber is adapted to gather light through the outer surface and provide visible light at least one of the ends of the fiber. A light-responsive element is associated with the fiber. The light-responsive element is operable to regulate the amount of incident light absorbed by the fiber and respond to the ambient light impinging on the fiber. The light-responsive element may be an externally positioned shield, a coating on the fiber, or may be infused into the fiber itself. The light-responsive element is light sensitive and may reversibly change, e.g., in "color", upon exposure to a specific wave length band of light such as ultraviolet light. Its ability to transmit light at a sighting end is reduced relative to a change in the incident light. The fiber can be mounted to a mount structure and be selectively movable relative to the mount structure. The mount structure in turn can be secured to an object such as a bow typically on the riser portion of the bow. Windage and elevation adjustments may be provided in the mount structure.

BRIEF DESCRIPTION OF THE SEVERAL VIEWS OF THE DRAWING

Like numbers throughout the various Figures designate like or similar parts.

DETAILED DESCRIPTION OF THE INVENTION

Figure 1:
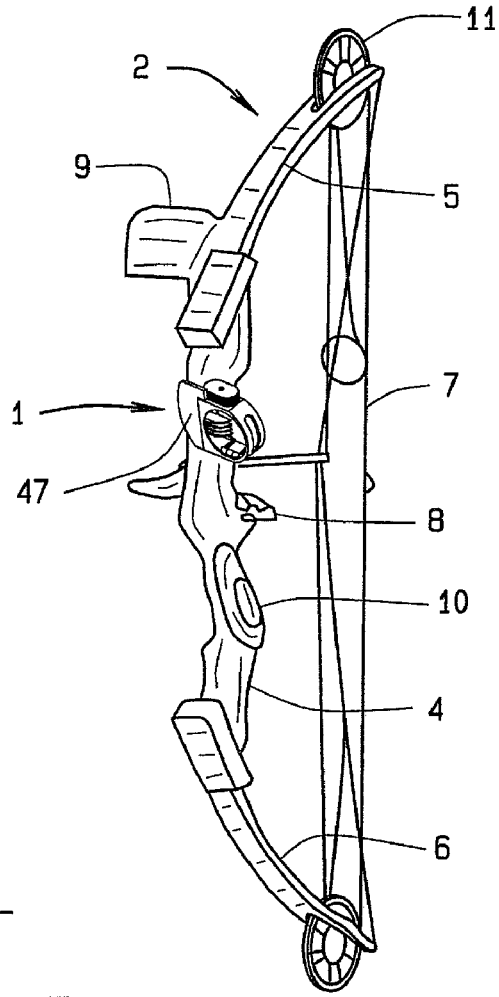
FIG. 1 is a perspective view of a bow sight mounted to a bow.
Figure 2:
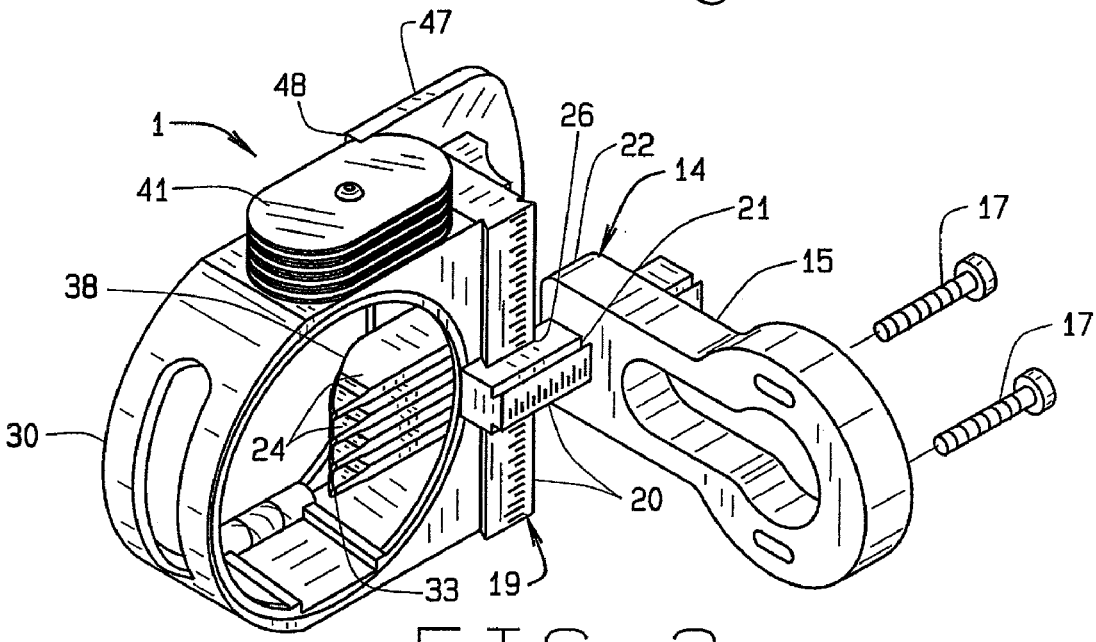
FIG. 2 is an enlarged perspective view of the bow sight.
Figure 3:
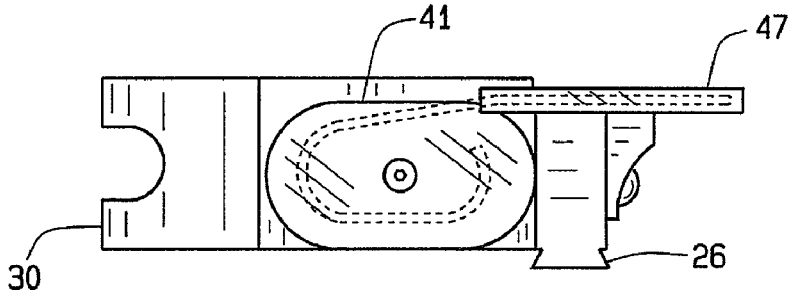
FIG. 3 is a top plan view of the bow sight.
Figure 4:
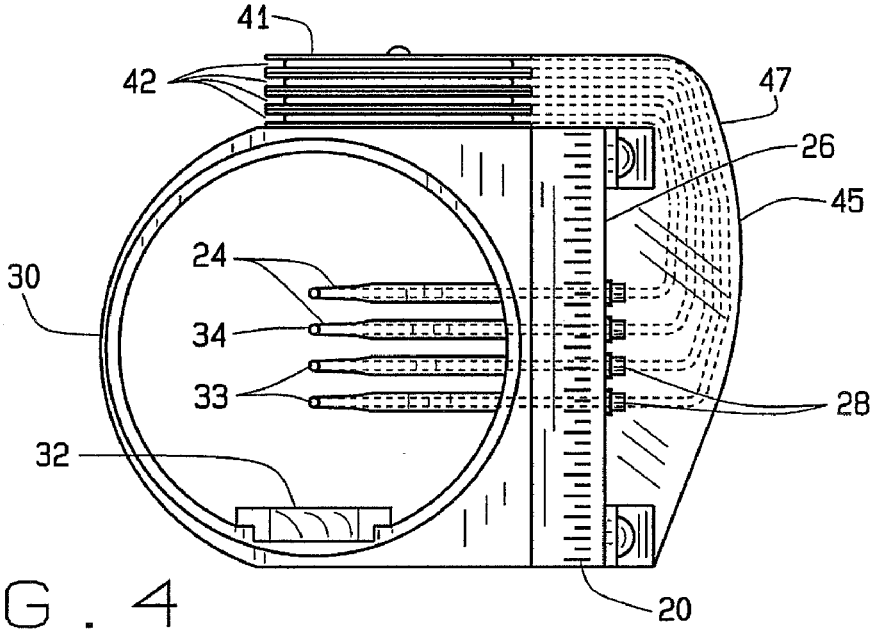
FIG. 4 is an elevation view of the bow sight as seen from the archer's side.

The referenced numeral 1 designates generally a sighting device for use on a bow designated generally 2. Although the sight device is shown as a bow sight, it is to be understood that the sight device can also be utilized with such long-range weapons as rifles, pistols and shotguns as well as other devices that are aimed visually.

The bow 2 can be of any suitable type known in the art and, as shown, includes a riser 4, a top limb 5, a bottom limb 6, a string 7, an arrow rest 8 and a hand grip 10. In the case of a compound bow, a cam 11 may be mounted at either or both of the ends of the limbs 5 and 6. Other known devices may be mounted to the bow including a stabilizer, a reel and a quiver 9. Typically bow risers 4 are made of a metal alloy and the limbs can be made of a flexible fiberglass or other fibrous material such as graphite fibers. The riser 4 typically is provided with means for mounting various devices to the bow and typically include threaded holes for receipt of threaded fasteners such as Allen head cap screws or Torx® screws.

The sight 1 includes a mount structure 14 adapted for mounting the sight to a device to be aimed, for example, the bow 2. The mount 14 includes an arm 15 that is sized and shaped for securement to the riser 4 as, for example, with threaded fasteners 17. The sight 1 includes a frame structure 19 secured to the arm 15 preferably in a manner that allows the frame 19 to be movable relative to the arm 15 in at least one direction and preferably two orthogonal directions. Scales 20 may be provided for easy adjustment reference. As used herein, the terms vertical and horizontal are those directions as when the bow 2 or other object to be aimed is held in its normally upright orientation for aiming and use. In the illustrated structure, a first dovetail slide assembly 21 is movably mounted to a distal end 22 of the arm 15 and is movable horizontally relative to the arm allowing horizontal movement of the frame 19 with the sight pins 24 mounted to the frame 19. A second dovetail slide assembly 26 is mounted to the frame 19, and preferably to the first dovetail slide assembly 21, to permit selective vertical movement of the frame 19 relative to the arm 15. Horizontal movement of the frame 19 permits adjustment of the pins 24 for, what is commonly referred to as, windage and the second dovetail slide assembly 26 allows movement of the frame 19 for adjustment of the pins 24 for elevation (range). The frame 19 can be provided with one or more, and preferably two, tracks (not shown) in which the pins 24 are movably mounted to provide selective vertical spacing therebetween in order to provide aiming points for different ranges downrange to a target. The pins 24 can be mounted to the frame 19 by threaded fasteners 28 which permit the selective adjustment of the pins in spacing relative to one another. Thus, elevation can be adjusted by either moving the pins 24 and/or moving on the second dovetail slide assembly 26, and thereby the frame 19, in a vertical manner. The frame 19 can also be provided with a pin guard 30 to provide protection for the pins 24 from being damaged if the bow or other device to be sighted is dropped or accidentally strikes an object, e.g., a tree, vehicle or the like. A level indicator 32, such as a bubble level, can be provided on the frame 19 to indicate how close to vertical (and horizontal) the device to be aimed is oriented. An example of such a sight is the Skylight™ sight available from Montana Black Gold located in Bozeman, Mont.

Figure 5:
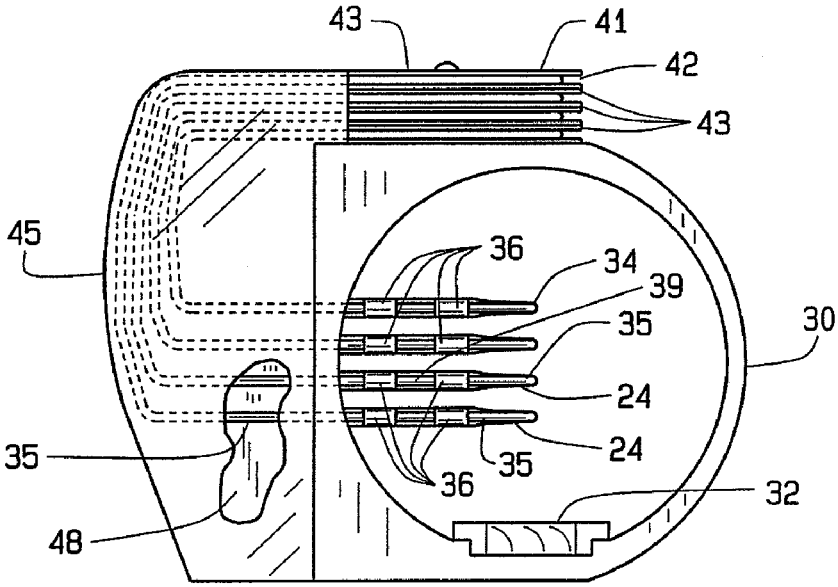
FIG. 5 is an elevation view of the bow sight as seen from the target side.
Figure 6:
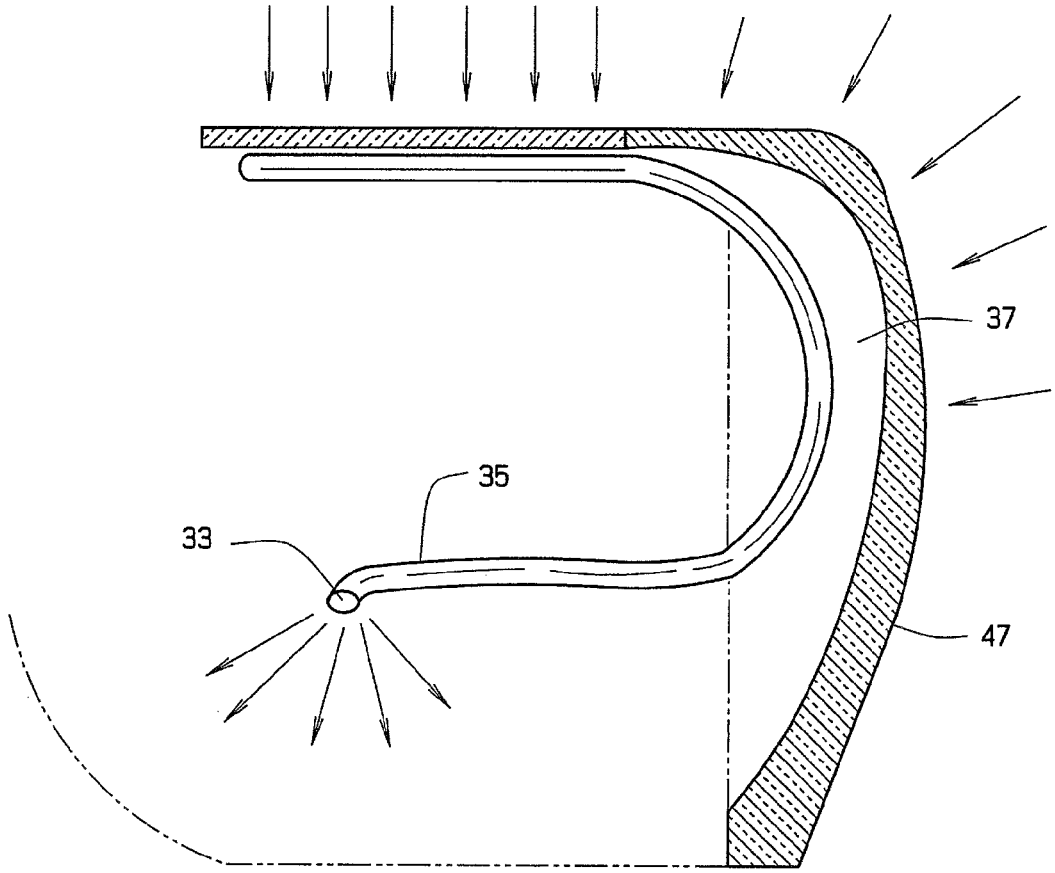
FIG. 6 is a schematic illustration of a fiber optic fiber and shielding structure.
Figure 7:
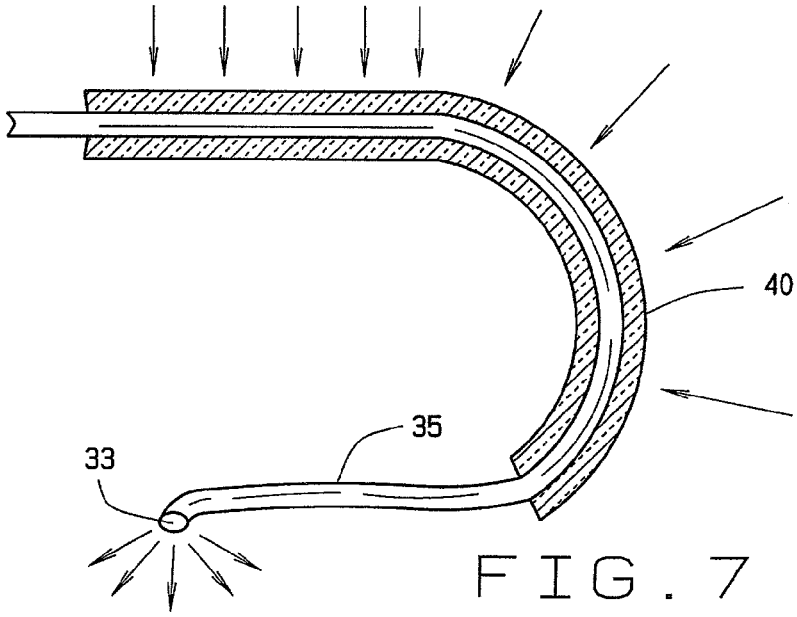
FIG. 7 is a schematic view of a modified form of fiber optic fiber.

The pins 24 have positioned adjacent a distal end 34 thereof, an illuminated end portion 33 of a light gathering fiber-optic fiber 35 so that the illuminated end 33 is visible by the person using the sight. The light gathering fiber 35 is mounted to the pin 24 in any suitable manner such as with clamp fingers 36 (FIG. 5). Preferably, a fiber 35 extends to the distal end 34 of the pin 24 on the front or target side 38 of the sight 1 to shield any light that may be transmitted from the side of the fiber from the archer's view. Each light gathering fiber 35 may be positioned within a respective groove 39 to help maintain its position on the front side 38 of the respective pin 24. The light gathering fibers 35 may be of any suitable material, for example, an optical grade acrylic and may be a single fiber or a multiple fiber bundle. The fiber 35 also may include a colorant to provide for different colors of emanated light for helping to distinguish between the various pins 24 during use. The length and diameter of a fiber 35 are tuned to provide an adequate or desirable amount of light transmitted from the viewing end of the fiber. Generally, the more surface area exposed to a given light, the more light absorbed and the more light that is available for transmission to an end 33 for viewing. As shown, the fibers 35 are curved and the curves are preferably kept large enough to reduce loss of light through the outer side surface 37 at the curves. Coatings 40 may also be applied to the fiber 35 to help absorb and prevent loss of light through the side surface 37. In a preferred embodiment, the fibers 35 are generally circular in transverse cross-section providing a generally smooth side surface 37. However, other shapes could be utilized if desired. In the illustrated structure, the fibers 35 extend from the pins 24 to a retaining structure for exposing a long length of fiber to light over a short distance. As shown, a magazine 41 is mounted on the upper portion of the guard 30 and has a plurality of grooves 42 each for receiving a respective fiber 35 therein allowing the fiber 35 to be wrapped within the magazine to provide a long length of fiber 35 while the fiber 35 is maintained in a short length of frame span. Light may then be transmitted through the groove defining plates 43 of magazine 41 for absorption of light by the fibers 35. As shown, there are four grooves 42 which will accommodate four fibers 35. Any number of fibers 35 can be used, numbering one or more. Four fibers are preferred since typically bows are set for 20, 30, 40 and 50 yard ranges. However, other ranges may be set for the pins 24. Because modern bows shoot relatively flat whereby the pins 24 are relatively close together for closely spaced range increments, e.g., 10 yard increments. However, by being close together, the fiber-optic fibers 35 are preferably of a small cross-sectional area or dimension to allow close spacing of the pins 24 while allowing target viewing between the pins. It has been found that a fiber 35 on the order of from about 3 to 16 inches, and preferably 0.03 inches, provides adequate light, adequate view of the target and sufficient smallness with close spacing of the pins 24. A fiber 35 having a diameter of from about 0.020 to 0.040 inches, and preferably 0.03 inches, and length on the order of 4 to 8 inches and preferably, has been found adequate. However, such a length can be unwieldy since sights do not have any convenient retaining structure dimension as long as the fiber 35. Thus, it is preferred to wrap the fibers 35 in a light transmissive structure such as the magazine 41 to provide compactness of structure while providing long length of fiber 35.

An intermediate portion 45 of a fiber 35 extends from the magazine 41 to the pins 24. It is preferred to protect the intermediate portion 45 from damage while still providing absorption of light along the intermediate portion. This can be done by providing a guard housing 47 having an interior chamber 48 thereby enclosing substantially the entirety of the intermediate portion 45 therein. It is preferred that the housing 47 have light-transmissive walls to allow for light to be incident upon the intermediate portions 45 and be absorbed thereby. A preferred material for the housing 47 and magazine 41 is polypropylene plastic which provides both durability, light transmission and protection for the fibers 35. A preferred light-sensitive material, such as photochromic material, for incorporation into the housing 47 and magazine 41 is polypropylene. As shown, the housing 47 is removably secured to the guard 30 such as by screw fasteners that extend through mounting brackets 51. It is preferred that the housing 47 and the intermediate fiber portions 45 contained therein are positioned on the front side of the sight 1 while the magazine 41 is preferably mounted on the top of the guard 30 providing greater access to light during normal shooting orientations of the bow or the like.

The bow sight 1 with accompanying fibers 35 is constructed to regulate the output of light from the sighting end 33 of the fibers 35 and, in one embodiment, in an automatic manner. Light output may be regulated by controlling the incident light absorption and/or the light transmission by and through a fiber-optic fiber 35. A light sensitive element is provided that is responsive to a change in a property or characteristic of the incident light and will regulate the amount of light transmitted from an end 33. The property of light utilized may include incident light intensity and/or color. This can be done by providing a fiber that reversibly changes transmissivity upon a change in the property level of incident light. In one embodiment, this can be done by providing an element associated with a fiber 35 that reversibly changes in response to a change in the intensity of light impinging on the fiber-optic fiber 35. For example, light in the UV (ultraviolet) range can activate photo-sensitive compounds that will reversibly change as the intensity of ultraviolet light changes. One method of and means of accomplishing this is through the use of photochromic materials. Photochromic materials are well known in the art. In one embodiment, the photochromic materials may be incorporated into the materials of the magazine 40 and housing 47. Thus, as light intensity increases, the photochromic element darkens reducing the amount of available light to be absorbed and/or transmitted by one or more of the fibers 35 as a percent of the incident light. The photochromic element may be associated with a fiber 35 as a coating applied to the outer surface of a fiber 35. Additionally, the light sensitive element may be incorporated directly into the material comprising the fiber 35. In the coating application, the coating may be applied through a method such as passing the fiber through a bath or may be co-extruded with the fiber 35 as an outer layer. As the light intensity increases, light absorption is impeded as a percent of incident light and as incident light intensity decreases, the light-sensitive element becomes more light transmissive and light absorptive as a percent of incident light thereby providing a more constant light output at the sighting end 33 of a fiber 35.

The fibers 35 are self-regulating to maintain a more substantially constant level of light being transmitted from the end of the fiber-optic fiber 35 whereby tuning of a fiber is improved for a wider spectrum of impinging light. As the incident light changes in intensity or color, the light sensitive element automatically regulates light output from an end 33. As one or more components of incident light changes, such as by increasing, light absorbed correspondingly changes by decreasing.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow. While it is believed that the theories advanced herein regarding light absorption and transmission are correct, applicant is not bound thereby.

The invention claimed is:

1. A bow sight including:

a frame;

at least one sight pin mounted on the frame;

at least one light-transmissive fiber associated with a respective said pin; and a light-sensitive element associated with at least one said fiber and operable to regulate an amount of light being transmitted from the fiber in response to a change in incident light on the light-sensitive element which darkens with increasing light intensity.

2. A bow sight as set forth in claim 1 wherein the light-sensitive element being operable to reduce the percent of light absorption in response to an increase in at least one component of the incident light.

3. A sight device for use with a shooting device including:

a mount adapted for securement to a shooting device;

a light-transmissive fiber secured to said mount; and a light-sensitive element associated with said fiber and operable to regulate an amount of light being transmitted from the fiber in response to a change in incident light on the light-sensitive element which darkens with increasing light intensity.

4. A sight device as set forth in claim 3 wherein the light-sensitive element includes a photochromic material.

5. A sight device as set forth in claim 4 wherein the light-sensitive element includes a light-transmissive housing covering at least a portion of the fiber.

* * * * *